US008794351B2

(12) United States Patent
Krohn et al.

(10) Patent No.: US 8,794,351 B2
(45) Date of Patent: Aug. 5, 2014

(54) DEVICE AND METHOD FOR DRILLING WITH CONTINUOUS TOOL ROTATION AND CONTINUOUS DRILLING FLUID SUPPLY

(75) Inventors: Helge Krohn, Sandnes (NO); Mads Grinrød, Stavanger (NO); Odd B. Skjaerseth, Stavanger (NO)

(73) Assignee: West Drilling Products AS, Stavanger (NO)

( * ) Notice: Subject to any disclaimer, the term of this patent is extended or adjusted under 35 U.S.C. 154(b) by 0 days.

(21) Appl. No.: 13/521,716

(22) PCT Filed: Jan. 25, 2011

(86) PCT No.: PCT/NO2011/000028

§ 371 (c)(1),
(2), (4) Date: Sep. 13, 2012

(87) PCT Pub. No.: WO2011/093716

PCT Pub. Date: Aug. 4, 2011

(65) Prior Publication Data

US 2013/0192895 A1 Aug. 1, 2013

(30) Foreign Application Priority Data

Jan. 26, 2010 (NO) ..... 20100123

(51) Int. Cl.

| | |
|---|---|
| ***E21B 7/00*** | (2006.01) |
| ***E21B 3/04*** | (2006.01) |
| ***E21B 3/02*** | (2006.01) |
| ***E21B 19/16*** | (2006.01) |
| ***E21B 19/00*** | (2006.01) |

(52) U.S. Cl.

CPC ... *E21B 3/04* (2013.01); *E21B 3/02* (2013.01); *E21B 19/16* (2013.01); *E21B 19/00* (2013.01)

USPC ..... 175/57; 166/380

(58) Field of Classification Search

USPC ..... 175/162, 57; 166/380, 81.1

See application file for complete search history.

(56) References Cited

U.S. PATENT DOCUMENTS 3,994,350 A * 11/1976 Smith et al. ..... 175/85
4,449,596 A * 5/1984 Boyadjieff ..... 175/85

(Continued)

FOREIGN PATENT DOCUMENTS

GB 2 399 112 A 9/2004
NO 326427 B1 12/2008

OTHER PUBLICATIONS

International Search Report for parent application PCT/NO2011/000028, having a mailing date of Apr. 4, 2011.

(Continued)

*Primary Examiner* — Nicole Coy

(74) *Attorney, Agent, or Firm* — Andrus Intellectual Property Law, LLP

(57) ABSTRACT

A device is for a drilling rig for forming of a bore hole in a subterranean structure. The drilling rig comprises a first, top driven drilling machine arranged vertically displaceable along a guide track, where a second drilling machine is arranged between the first drilling machine and the bore hole, vertically displaceable along a guide track and provided with a rotary table arranged to be able to take the weight of a pipe string. A rotary drive unit is arranged for continuous rotation of the pipe string. A fluid chamber is arranged to, in a fluid communicating way, be able to connect a pipe string end portion with a drilling liquid plant. As the fluid chamber is provided with pipe string ports comprising means arranged to, in a fluid sealing way, be able to close the pipe string ports. A power tong is arranged for continuous rotation of an element connected to the pipe string, as the power tong is arranged in the fluid chamber. Also, a method is for drilling with continuous tool rotation and continuous drilling liquid supply.

1 Claim, 7 Drawing Sheets

(56) References Cited

U.S. PATENT DOCUMENTS

| | | | | |
|---|---|---|---|---|
| 6,412,554 | B1 | 7/2002 | Allen et al. | |
| 6,591,916 | B1 * | 7/2003 | Ayling | 166/380 |
| 6,688,394 | B1 | 2/2004 | Ayling | |
| 7,107,875 | B2 * | 9/2006 | Haugen et al. | 81/57.15 |
| 2003/0075023 | A1 | 4/2003 | Robichaux | |

OTHER PUBLICATIONS

Written Opinion for parent application PCT/NO2011/000028, having a mailing date of Apr. 4, 2011.

* cited by examiner

DEVICE AND METHOD FOR DRILLING WITH CONTINUOUS TOOL ROTATION AND CONTINUOUS DRILLING FLUID SUPPLY

CROSS-REFERENCE TO RELATED APPLICATIONS

This application is the U.S. national stage application of International Application No. PCT/NO2011/000028, filed Jan. 25, 2011, which International application was published on Aug. 4, 2011 as International Publication No. WO 2011/093716 A1 in the English language and which application is incorporated herein by reference. The International application claims priority of Norwegian Patent Application No. 20100123, filed Jan. 26, 2010, which application is incorporated herein by reference.

BACKGROUND

The invention relates to a device for a drilling rig for forming of a borehole in a subterranean structure, where the drilling rig comprises a first top driven drilling machine arranged vertically displaceable along a guide track, more particularly in that a second drilling machine is arranged between the first drilling machine and the bore hole vertically displaceable along a guide track and provided with a rotary table arranged to be able to take the weight of a pipe string, a rotary drive unit arranged for continuous rotation of the pipe string, a fluid chamber arranged to in a fluid communicating manner to connect a pipe string end portion with a drilling fluid plant, as the fluid chamber is provided with pipe string ports comprising means arranged to in a fluid sealing manner to close the pipe string ports, and a power tong arranged for continuous rotation of an element connected to the pipe string, as the power tong is arranged in the fluid chamber. Also described is a method for drilling with continuous tool rotation and continuous drilling fluid supply.

During drilling in the underground, such as in exploration and production drilling in connection with exploitation of oil and gas, new sections of drill pipe are steadily joined as the hole is extended. In every such operation the rotation of the pipe string is stopped, and in most techniques in use, the circulation of drilling liquid is simultaneously stopped while the pipe string is extended. The drawback of such disruption in the rotation and drilling liquid circulation is well known within the industry. The transport of cuttings out of the well is stopped, and the cuttings will thereby start to sink, and in horizontal bore hole portions the cuttings may sediment. This may bring about time loss in that drilling liquid must be circulated for some time before the drilling operation is restarted to clean up the bore hole. When the pipe string rotation is stopped, the risk of the pipe string getting stuck in the bore hole is also increased due to collection of the sinking cuttings and increased friction against the formation wall as a consequence of the pressure difference between the bore hole and the formation around the hole. A further drawback is that a stop in the drilling liquid circulation leads to pressure variations in the drilling liquid, and if the pressure comes outside critical limits, the formation fluid may get into the bore hole or drilling liquid may get out into the formation, and both situations are undesirable.

From NO326427 is known a device for a top drive where a drive shaft arranged for releasable connection to a drive gear and with a first end portion of a drill pipe, is provided with a central run therethrough arranged for fluid communication between the drilling liquid plant and a fluid run in the drill pipe. A first and a second releasable, drive shaft enclosing or pipe string enclosing, respectively, pressure seal and a valve arranged for in an open position to provide a passage for the drill pipe or the drive shaft, form a first and a second chamber. A drilling liquid inlet is allocated to the second chamber and is arranged for fluid communication between the drilling liquid plant and the coupling housing. Thereby is provided a possibility for continuous drilling liquid circulation, but at installation of a new drill pipe section the pipe string rotation has to be stopped.

GB 2399112 describes a method and an apparatus for connecting pipe components during drilling without the pipe string rotation or the fluid circulation through the pipe string is stopped. This is achieved by cooperation between a top drive and a rotary table. A fluid circulation device being joined to the threaded portion on the pipe components is used for fluid circulation when the top drive is disconnected from the pipe string.

U.S. Pat. No. 6,412,554 describes a system for continuous circulation of fluid to and through a pipe string, for example a coiled tubing or a pipe string made up of pipe sections screwed together. The system comprises an upper and a lower chamber having through openings for receiving the pipe string, as sealing devices are arranged at an upper and a lower opening and is arranged to fit tightly around the pipe string. The system also comprises devices for rotation and axial displacement of the pipe string or pipe components relative to the chambers.

SUMMARY

The object of the invention is to remedy or reduce at least one of the disadvantages of the prior art, or at least to provide a useful alternative to the prior art.

The object is achieved by the features disclosed in the below description and in the subsequent claims.

There is provided a device for a drilling rig having the possibility for both continuous rotation of a pipe string and continuous circulation of drilling liquid so that drilling of a portion of a well may go on uninterrupted. The invention will be able to contribute to increase productivity during establishing of a bore hole. There is employed two drilling machines arranged above a drill floor and axially coinciding with the central axis of the drill floor, a first, upper drilling machine being a top drive according to prior art and performing the essentials of a drilling operation including pipe string rotation, drilling liquid supply to the pipe string, axial displacement of the pipe string and also rotation of a drill pipe section relative to the pipe string during jointing of the pipe string, and a second, lower drilling machine being provided with means arranged to be able to suspend and at the same time rotate the pipe string, in addition to being able to supply drilling liquid to the pipe string.

Both drilling machines comprise means arranged for vertical, independent displacement along guide tracks in a derrick extending upward from a drill floor or the like. The drilling machines may be connected to the same set of guide tracks.

The first drilling machine has a downward extending drive shaft, which for practical purposes is normally provided with a drive shaft extension. In the further description the term "drive shaft" covers the at any time employed drive shaft whether it being physically extended with a releasable unit, or the drive shaft is provided as one element. Where a drive shaft extension is expressly conditional, the term "drive shaft extension" is used.

The second drilling machine is provided with a central through opening and comprises a rotary table arranged for continuous rotation of the pipe string and is provided with means for suspension of the pipe string, for example in the form of so-called "power slips". Above the rotary table is arranged a rotary drive unit arranged for releasably being able to be connected to a portion of the pipe string. A power tong arranged for continuous rotation is placed above the rotary drive unit and is arranged in a fluid chamber. The fluid chamber is provided with an upper and a lower port coincident with the pipe string axis and arranged for feeding through of a drill pipe, as both ports are provided with pressure seals arranged to close tightly around the pipe string or a pipe string section. The upper port is in addition provided with a stop valve arranged to be able to close said port and also in an open position to make through feeding of a pipe string section possible. The fluid chamber is provided with means arranged for supply of pressurised drilling liquid and also draining of fluid from the fluid chamber. The fluid chamber is advantageously provided with ventilation means arranged to lead air or another gas into or out of the fluid chamber.

A drilling operation is carried out in the following manner:

a) The first drilling machine rotates the pipe string and supplies drilling liquid to the central opening in the pipe string in a per se known manner until the pipe string must be extended with a new pipe section. The pipe section is suspended in the rotary table. A portion of the first drilling machine drive shaft, or possibly a drive shaft extension, (in the following called "drive shaft" for simplicity) extends down into the fluid chamber and is enclosed by the power tong. The pressure seals enclose the pipe string and the drive shaft.

b) After adaptation of the rotary drive unit rotational speed to correspond to the pipe string rotational speed the rotary drive unit and the pipe string are joined while the pipe string rotates. The first drilling machine may thereafter be disengaged as the pipe string rotation is now taken care of by the lower drilling machine.

c) After adaptation of the power tong rotational speed to correspond to the pipe string rotational speed this engages the drive shaft. The pressure seals are activated.

d) By synchronised operation of the rotary drive unit and the power tong, the threaded connection between the drive shaft and the pipe string is broken at the same time as the fluid chamber is pressurised. As the drilling liquid can flow into the pipe string from the fluid chamber, the supply of drilling liquid to the first drilling machine is closed.

e) The drive shaft is disengaged from the power tong, and at the vertical displacement of the first drilling machine it is pulled out of the stop valve, which is closed before the upper pressure seal is deactivated and the drive shaft is pulled out from the upper port of the fluid chamber.

f) The rotation and vertical displacement of the pipe string and also the supply of drilling liquid are maintained by means of the lower drilling machine while a new pipe string section is connected to the drive shaft of the first drilling machine.

g) The pipe string section is introduced into the upper fluid chamber port. The pressure seal is activated. The stop valve is opened and the pipe string section is displaced down into the fluid chamber for fixation in the power tong for connection with the pipe string in synchronised operation of the rotation of the rotary drive unit and the power tong at the same time as the drilling liquid supply through the first drilling machine is started and the drilling liquid supply through the fluid chamber stops.

h) Rotation, vertical displacement and drilling liquid supply are maintained by the first drilling machine as the lower drilling machine rotary drive unit is disengaged from the pipe string, the fluid chamber is drained and the pressure seals are deactivated.

i) The operations a)-h) are repeated until the drilling operation is completed.

In a third aspect the invention relates to use of a closable fluid chamber enclosing a power tong, for supply of drilling liquid to a pipe string by use of a drilling machine provided with a rotary table.

BRIEF DESCRIPTION OF THE DRAWINGS

In the following is described an example of a preferred embodiment illustrated in the accompanying drawings, wherein:

FIG. 4 shows the pipe string section connected to the first drilling machine and introduced into the upper port of the fluid chamber and sealingly enclosed by the port pressure seal;

FIG. 5 shows the pipe string section led through the fluid chamber stop valve and connected to the power tong set in rotation;

FIG. 6 shows the pipe string section disengaged from the power tong and connected to the pipe string now disengaged from the rotary table and driven by the first drilling machine, while the fluid chamber is being drained of drilling liquid; and FIG. 7 shows the pipe string driven by the first drilling machine and in free rotation relative to the lower drilling machine.

DETAILED DESCRIPTION OF THE DRAWINGS

Figure 1:
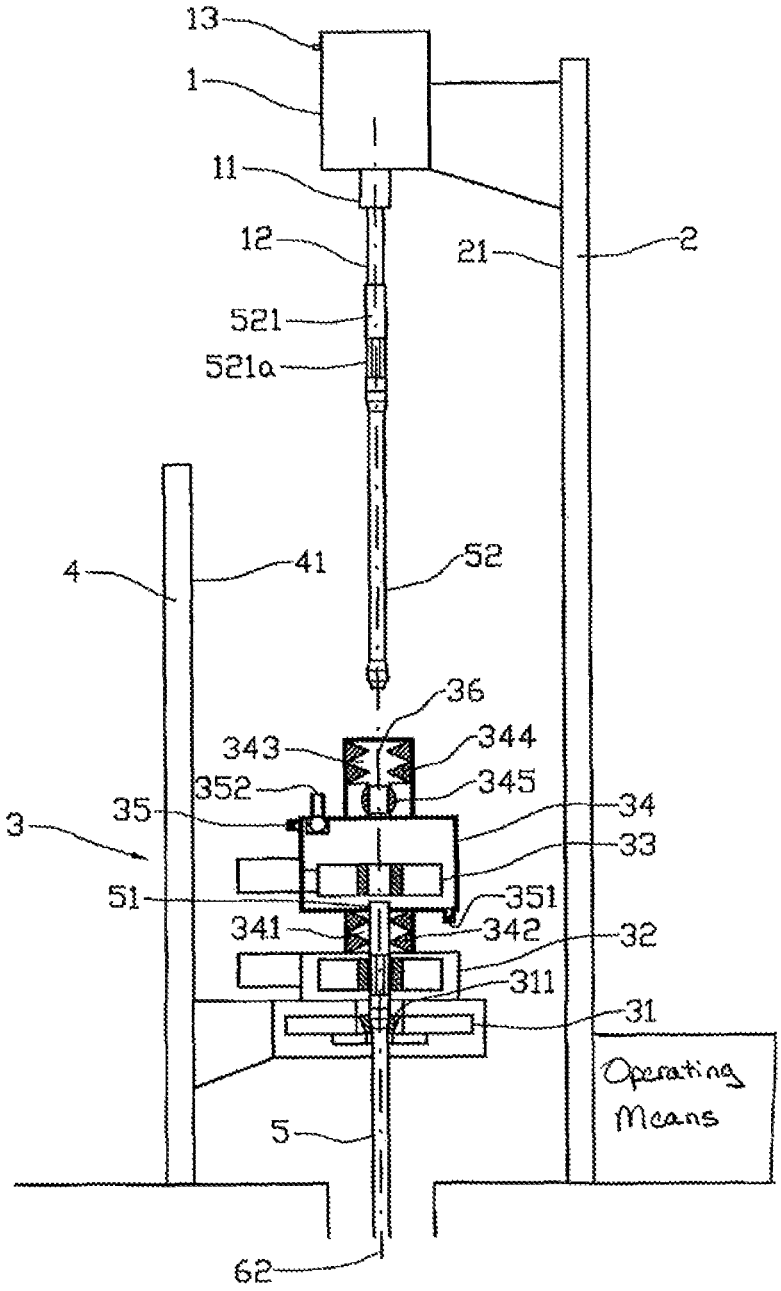
FIG. 1 shows a side view of a drilling rig comprising two cooperating drilling machines, where the lower drilling machine is sectioned.

In the drawings the reference numeral 1 indicates a per se known top drive, in the following also called the first drilling machine. It is in a normal manner provided with a drive shaft 11 and a drive shaft extension 12 and also a drilling liquid inlet 13 and is attached to a rig derrick 2 displaceable in the vertical direction along a guide track 21. The drilling machine 1 is arranged centric relative to the central axis 62 of a bore hole 6.

Between the first drilling machine 1 and the bore hole 6 is arranged a second drilling machine 3 attached to a second rig derrick 4 and displaceable in the vertical direction along a guide track 41.

Figure 2:
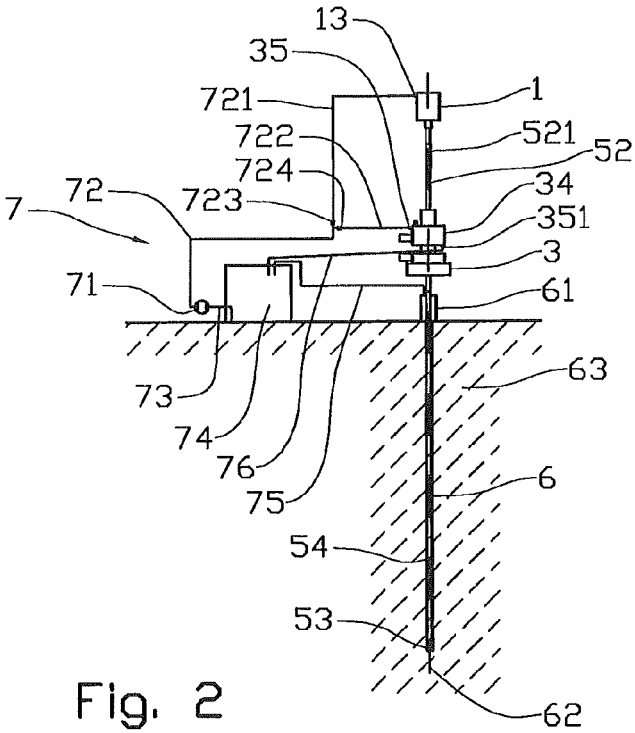
FIG. 2 shows schematically at a smaller scale a drilling liquid plant connected to the drilling machines.

A pipe string 5 extends downward in the bore hole 6 (see FIG. 2) and is composed of multiple pipe string sections 52 by threadable joining with an end portion 51 of the pipe string 5. The pipe string section 52 comprises a drive pipe 521 provided with a portion 521*a* having a polygonal cross-section arranged for releasable engagement with the second drilling machine 3. The pipe string 5 is provided with a drill bit 53.

The bore hole 6 extends from a wellhead 61 downward in a subterranean structure 63.

The drilling machines 1, 3 are in a fluid communicating way connected to a drilling liquid plant 7 comprising a drilling liquid pump 71, a supply line 72 arranged to lead pressurised drilling liquid to the drill bit 53 via the drilling machines 1, 3 and a central opening in the pipe string 5, a pumping line 73 which in a fluid communicating way connects the drilling liquid pump 71 with a drilling fluid reservoir 74, and a return line 75 connects the wellhead 61 and the drilling fluid reservoir 74.

The supply line 72 comprises a primary line 721 provided with a first stop valve 723 arranged to in a controlled way to lead drilling liquid to the first drilling machine 1, and a secondary line 722 provided with a second stop valve 724 arranged to in a controlled way to lead drilling liquid to the second drilling machine 3. A drain line 76 connects the second drilling machine with the drilling fluid reservoir 74.

The second drilling machine 3 comprises a rotary table 31 provided with power slips 311 arranged for suspension of the pipe string 5 in the rotary table 31 in a per se known way. Connected to the rotary table 31 is arranged a rotary drive unit 32 arranged for by releasable attachment to the polygonal portion 521*a* of the drive pipe 521 to be able to rotate the pipe string 5 about its central axis when it is suspended in the rotary table 31. Above the rotary table 31 is arranged a power tong 33 arranged for continuous rotation. The power tong 33 is enclosed in a fluid chamber 34 provided with a lower and an upper pipe string port 341 and 343 respectively. The pipe string ports 341, 343 are each provided with a pressure seal 342 and 344 respectively, arranged to by enclosing abutment against a portion of a portion of the pipe string 5, a pipe string section 53 or the drive shaft extension 12 of the first drilling machine to close the pipe string ports 341, 343. Between the fluid chamber 34 and the upper pressure seal 344 is arranged a stop valve 345, which in an open position is arranged for leading through of a pipe string section 52 and at least a downward extending end portion of the connected drive shaft extension 12.

The fluid chamber 34 is further provided with a drilling liquid inlet 35 in fluid communicating connection with the secondary line 722. A closable fluid chamber drain port 351 is arranged to be able to drain the fluid chamber 34 to the drilling liquid reservoir 74 via the drain line 76. A fluid chamber ventilator 352 is arranged in the upper portion of the fluid chamber 34 and is arranged to be able to ventilate the fluid chamber 34 for air and other gases when the fluid chamber is filled with or emptied for drilling liquid.

The rotary table 31, the rotary drive unit 32, the power tong 33 and the fluid chamber pipe string ports 341, 343 form a central opening 36 extending through the second drilling machine 3 and is arranged centrically relative to the bore hole 6 central axis 62.

Figure 7:
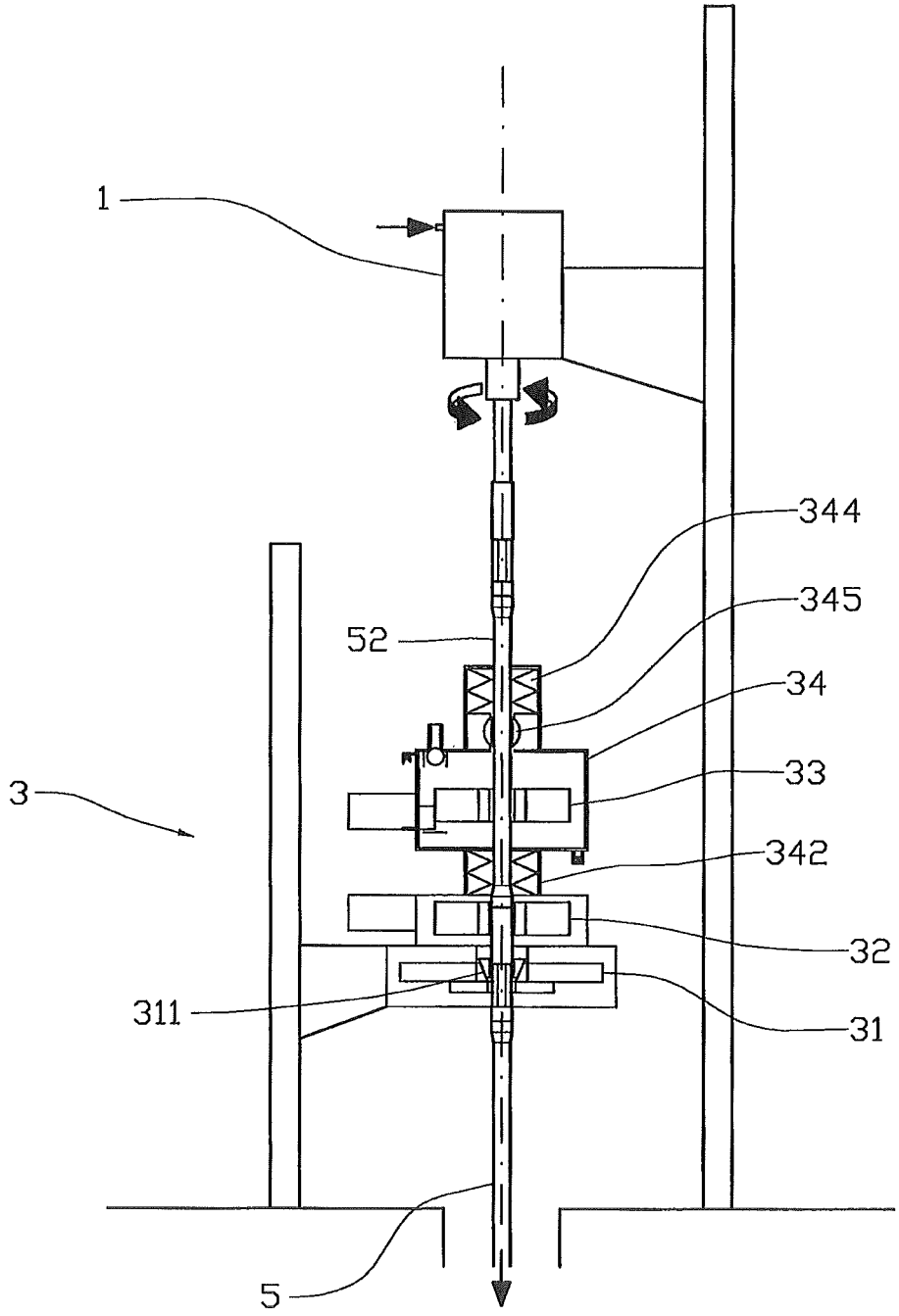

When a drilling operation is carried out with a drilling rig arranged according to the invention, the pipe string 5 is rotated and displaced in a first phase by means of the first drilling machine 1, as the pipe string 5 extends through the central opening 36 of the second drilling machine 3 and moves freely relative to the second drilling machine 3 (see FIG. 7). The drilling liquid is circulated via the drilling liquid inlet 13 of the first drilling machine 1 to the drill bit 53 and returns to the drilling liquid reservoir 74 via an annulus 54 (see FIG. 2), the wellhead 61, the return line 75 and necessary processing equipment (not shown) for per se known treatment of the drilling liquid. The second drilling machine 3 is displaced in the vertical direction to an upper starting position.

When a drive pipe 521 arranged uppermost in the pipe string 5, is positioned with its polygonal drive pipe portion 521*a* enclosed by the rotary drive unit 32 of the second drilling machine 3, this is set in rotation corresponding to the pipe string 5 and is led to engagement with the pipe string 5. The pipe string 5 is suspended in the rotary table 31 by means of the power slips 311 in a per se known way. The power tong 33 is set in rotation corresponding to the pipe string 5 and is led to engagement with the drive shaft extension 12 extending through the power tong. The rotation of the pipe string may now be carried out by the second drilling machine 3, as the drive gear of the first drilling machine 1 is disengaged.

In the next phase the lower and upper pressure seals 342, 344 and also the fluid chamber port 351 are closed, and drilling liquid is supplied to the fluid chamber 34 in that the respective stop valve 724 in the supply line 72 is opened. By means of a speed reduction in the power tong 33 relative to the rotary drive unit 32 the connection between the drive shaft extension and the pipe string is broken, and the drilling liquid is now supplied via the fluid chamber 34 and the open pipe string end portion 51. The drilling fluid supply to the first drilling machine 1 stops when the respective stop valve 723 in the supply line 72 is closed. The pipe string rotation and displacement of the pipe string 5 is for the time being carried out by the second drilling machine 3.

Figure 3:
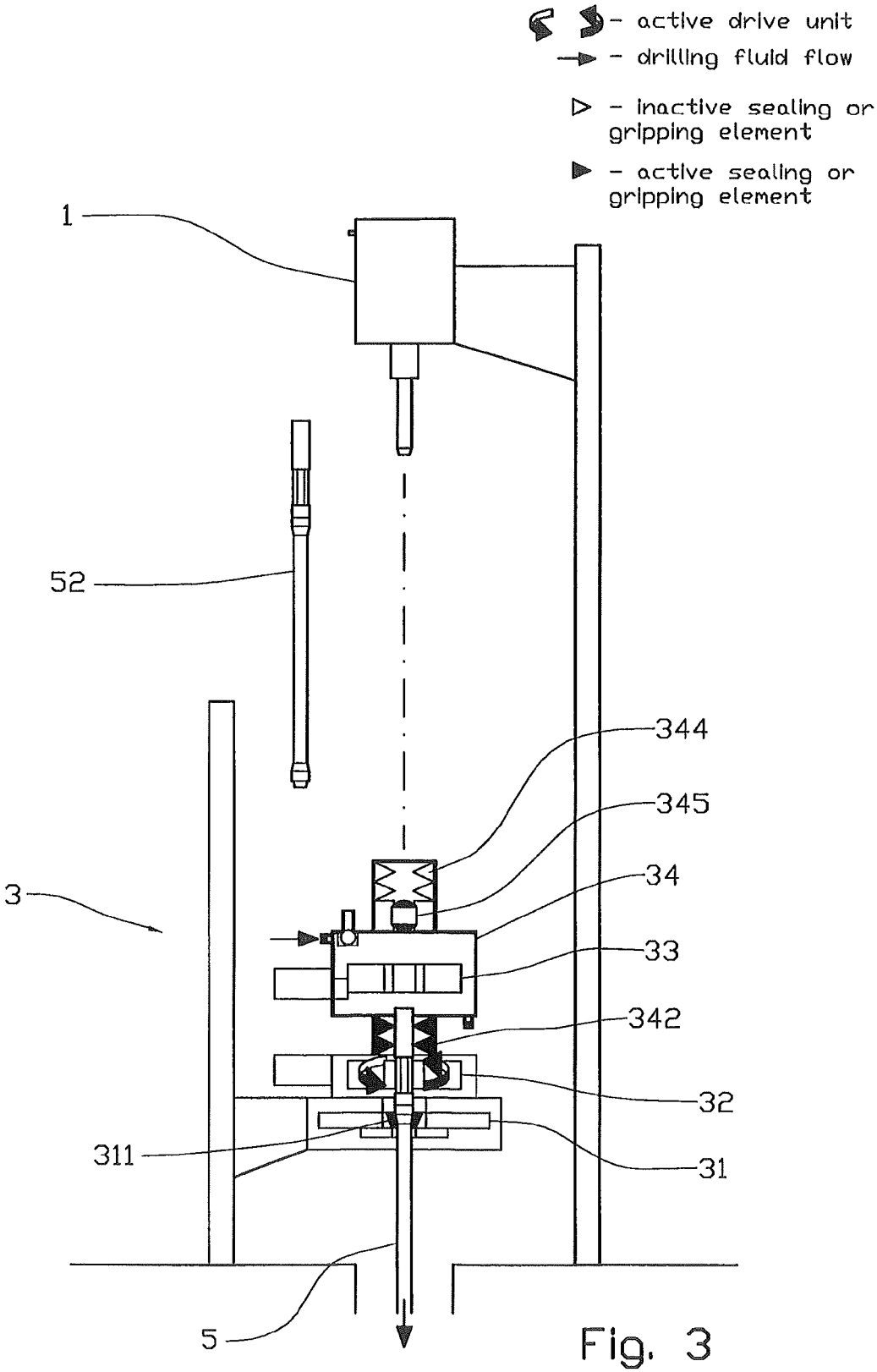
FIGS. 3 to 7 shows side views of different steps of a continuous drilling operation, whereby arrows and black, solid hachure indicate the unit being active and also where drilling fluid is flowing, as FIG. 3 shows the drill string operating by means of the lower drilling machine, and a pipe string section made ready for connection to the first drilling machine.

The first drilling machine 1 is now displaced away from the second drilling machine 3, as the stop valve 345 of the second drilling machine 3 is closed as soon as the drive shaft extension 12 is pulled out of the central run of the stop valve 345, while the upper pressure seal 344 is still closing pressure sealingly around the drive shaft extension 12. Thereafter the upper pressure seal 344 is pulled back and the drive shaft extension 12 is pulled away from the second drilling machine 3 for connection to the next pipe string section 52 (see FIG. 3).

Figure 4:
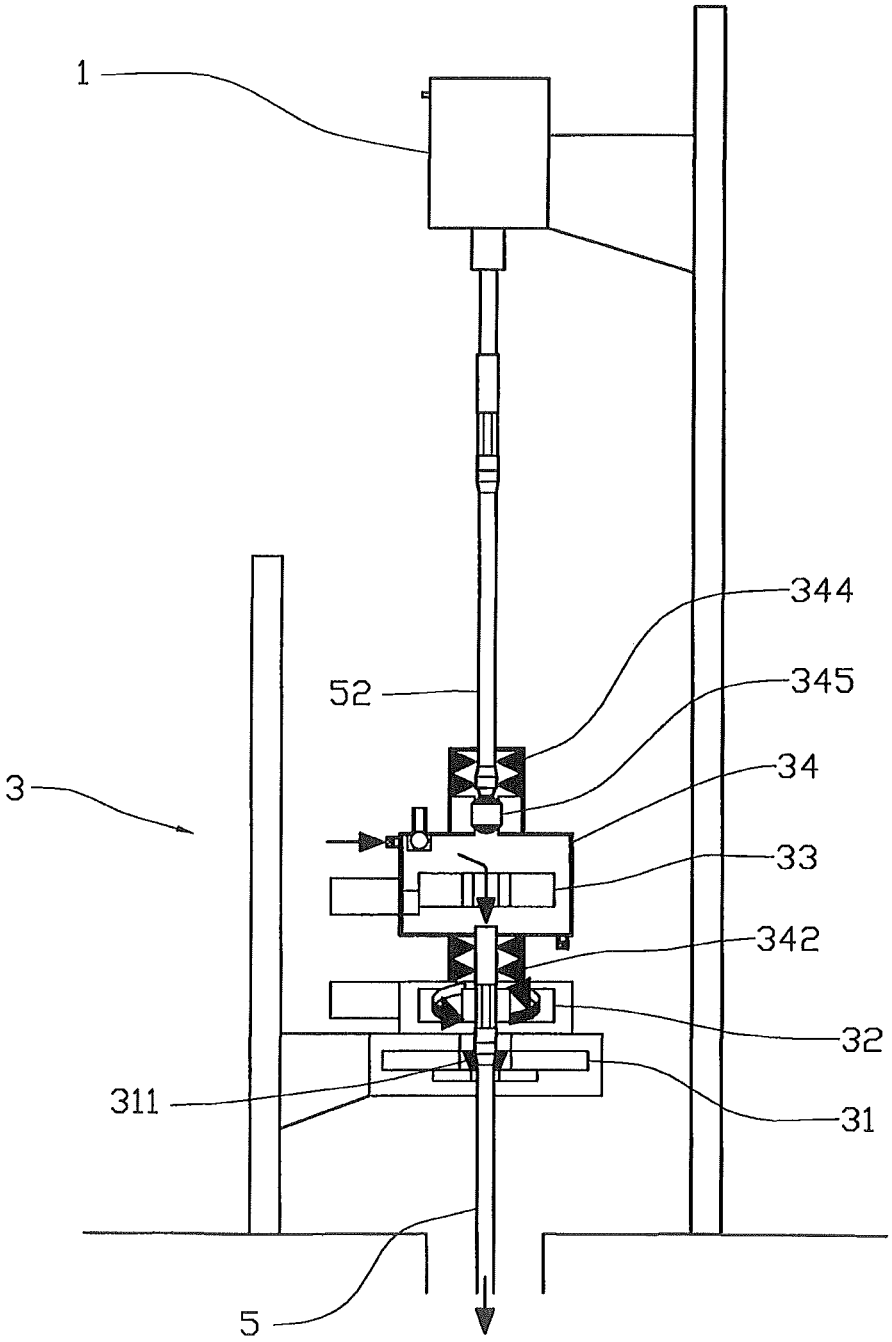
Figure 5:
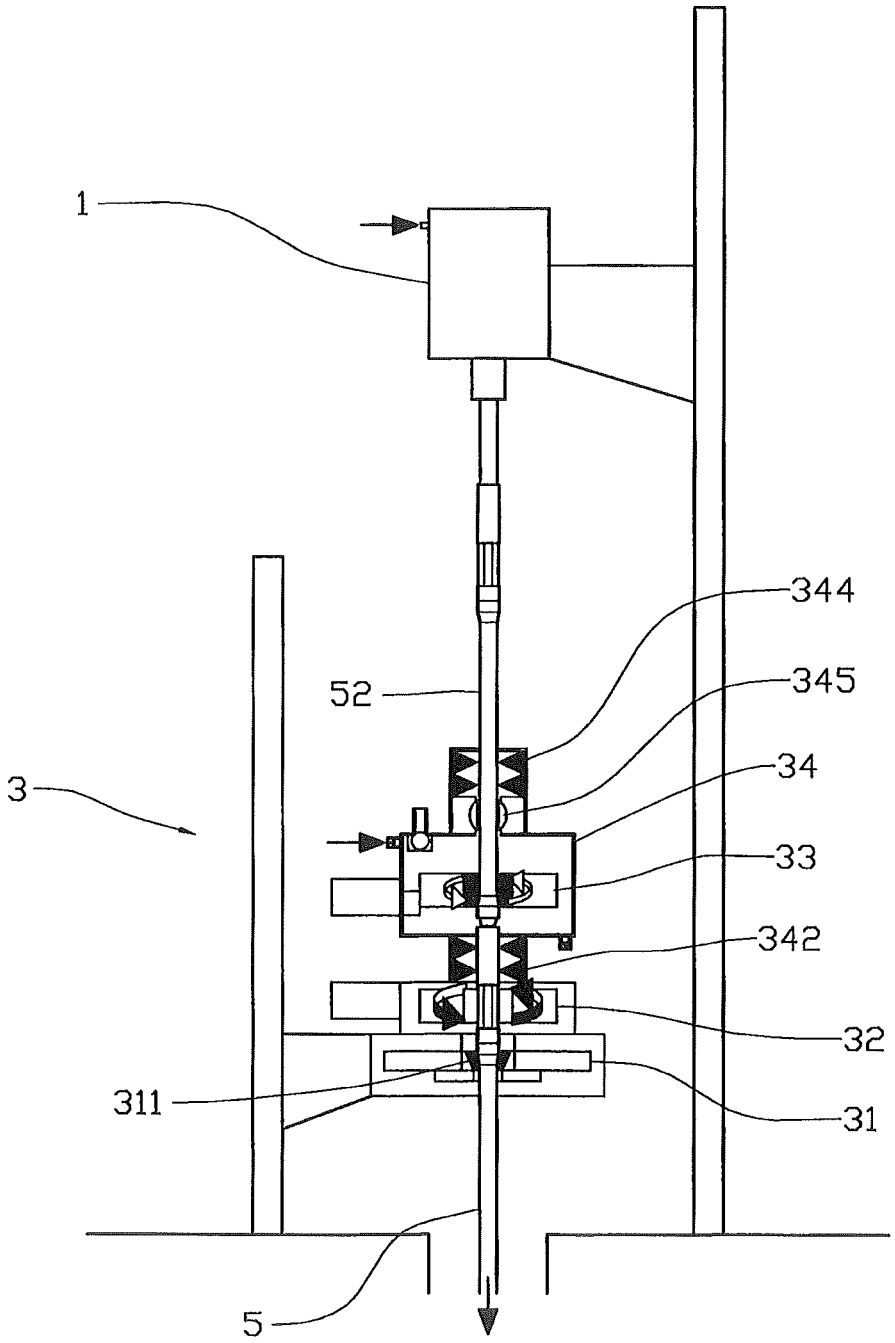
Figure 6:
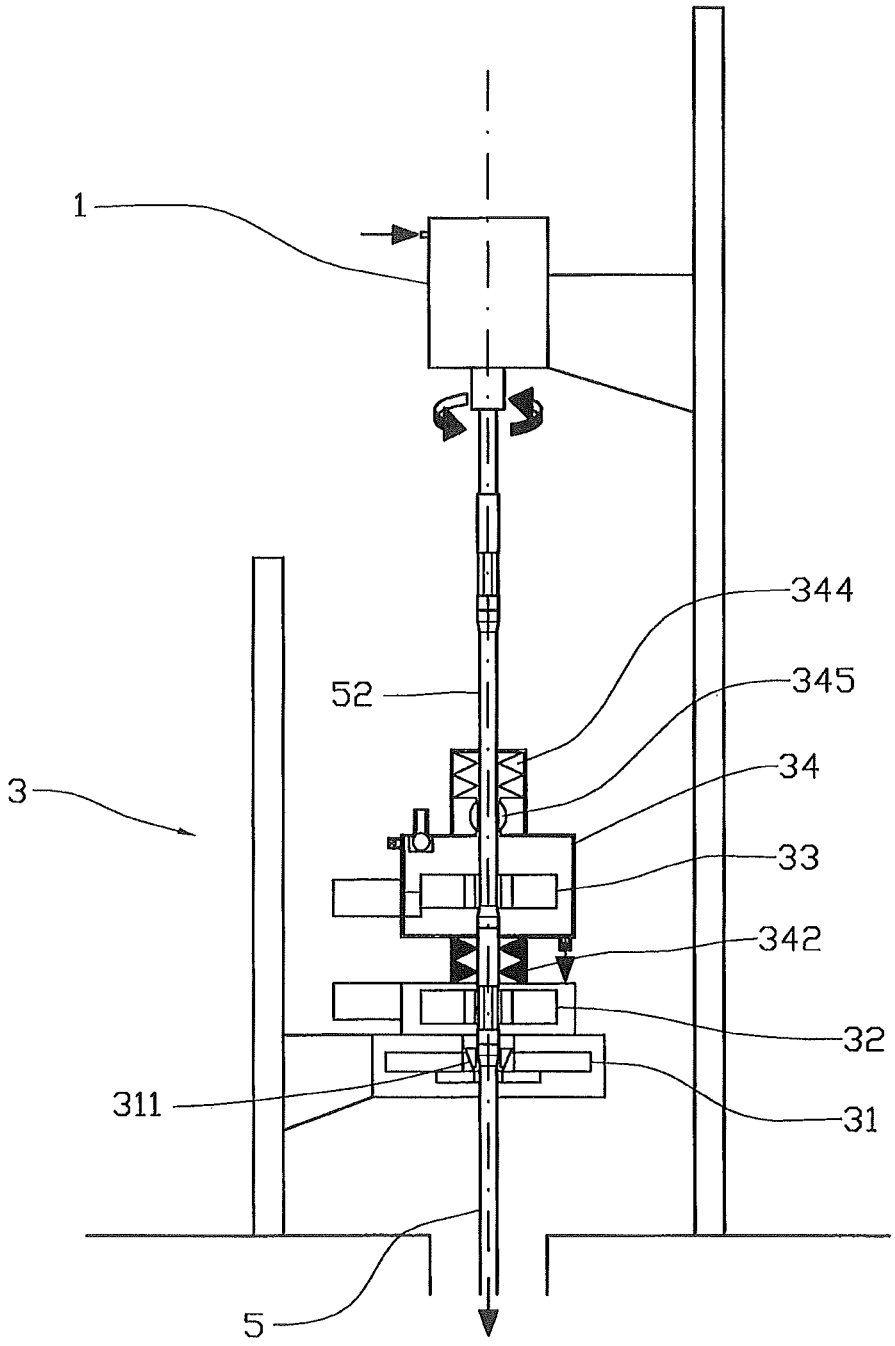

The first drilling machine 1 is displaced toward the second drilling machine 3 until a lower end portion of the pipe string section 52 is enclosed by the upper pressure seal 344 which is then being activated to close pressure sealingly around the pipe string section 52 (see FIG. 4). Thereafter the stop valve 345 is opened, and the first drilling machine 1 and the power tong 33 are set in rotation corresponding to the pipe string 5. Drilling liquid supply to the first drilling machine 1 is opened (see FIG. 5). The power tong 33 rotational speed is increased relative to the rotary drive unit 32 as the drive gear of the first drilling machine 1 is disengaged and the pipe string section 52 is displaced toward the pipe string 5 end portion 51 and connected to the pipe string 5. The closing of the respective stop valve 724 stops the supply of drilling liquid to the fluid chamber 34.

The rotary drive unit 32, the power tong 33 and the power slips 311 are disengaged from the extended pipe string 5 as the first drilling machine 1 is set in operation. The fluid chamber 34 is emptied of drilling liquid through the fluid chamber drain port 351 and the drain line 76, and the pressure seals 342, 344 are disengaged from their pressure sealing abutment against the pipe string 5.

The process is repeated until the desired position of the drill bit is reached.

It is obvious for a person skilled in the art to provide the drilling rig according to the invention with relevant monitoring and operating means for synchronising the various operations described above.

The invention claimed is:

1. A method for drilling with continuous tool rotation and continuous drilling liquid supply, the method comprising:

a) connecting a pipe string that is provided with a drill bit positioned in a bore hole in a subterranean structure to a drive shaft on a first, top driven drilling machine, leading the pipe string through a central opening on a second drilling machine, rotating and displacing the pipe string outwards in the axial direction of the bore hole white supplying drilling liquid to the drill bit via a drilling liquid inlet on the first drilling machine;

b) setting in rotation a rotary drive unit connected to a rotary table in the second drilling machine with a speed corresponding to rotation of the pipe string;

c) leading the rotary drive unit to engagement with an upper portion of the rotating pipe string;

d) leading closable pressure seals formed in pipe string ports in a fluid chamber arranged between the rotary table and the first drilling machine to pressure sealing abutment against a respective one of a portion of the pipe string and a portion of the drive shaft;

e) setting a power tong arranged in the fluid chamber in rotation with a speed corresponding to the rotation of the drive shaft;

f) leading the power tong to engagement with a portion of the drive shaft;

g) reducing the power tong rotational speed relative to the rotary table so that the drive shaft is disengaged from the pipe string at the same time as a fluid communicating connection is established between a drilling liquid plant and the drill bit via the fluid chamber and an open, upper pipe string end portion, followed by the drilling liquid supply to the first drilling machine being stopped;

h) displacing the drive shaft out of the fluid chamber, the first drilling machine being displaced away from the second drilling machine as the stop valve is closed and an upper pressure seal is disengaged from the abutment against the drive shaft;

i) connecting a pipe string section to the drive shaft of the first drilling machine and displacing the pipe string section into the fluid chamber, the upper pressure seal being led to abutment against the pipe string section and the stop valve is opened;

j) leading the power tong to engagement with a portion of the pipe string section and providing a rotation speed on the pipe string section greater than the rotation speed of the pipe string;

k) displacing the power tong toward the pipe string to connect the pipe string section with the pipe string, the drilling liquid supply to the first drilling machine being re-established, whereafter the drilling liquid supply to the fluid chamber is stopped;

l) operating the first drilling machine to resume the rotation and vertical displacement of the drilling string, the fluid chamber being drained out through a drain port to a drilling liquid reservoir, whereafter the pressure seals are disengaged from abutment against the pipe string; and m) repeating the steps b)-l).

* * * * *